US007654521B2

(12) United States Patent
Simonis et al.

(10) Patent No.: US 7,654,521 B2
(45) Date of Patent: Feb. 2, 2010

(54) APPARATUS, METHOD AND PROGRAM PRODUCT FOR DETECTING ARTICLE MULTIFEED OVERLAP

(75) Inventors: Roland Simonis, Evanston, IL (US); Paul Ridl, Lake in the Hills, IL (US)

(73) Assignee: Eastman Kodak Company, Rochester, NY (US)

( * ) Notice: Subject to any disclaimer, the term of this patent is extended or adjusted under 35 U.S.C. 154(b) by 205 days.

(21) Appl. No.: 11/019,108

(22) Filed: Dec. 22, 2004

(65) Prior Publication Data

US 2005/0228535 A1 Oct. 13, 2005

Related U.S. Application Data

(60) Provisional application No. 60/559,652, filed on Apr. 6, 2004.

(51) Int. Cl.
*B65H 7/12* (2006.01)

(52) U.S. Cl. ..... 271/262; 271/265.04; 271/258.01

(58) Field of Classification Search ..... 271/258.01, 271/262, 265.04, 265.01; 700/228
See application file for complete search history.

(56) References Cited

U.S. PATENT DOCUMENTS 2,675,233 A * 4/1954 Cival et al. ..... 271/259
2,894,626 A * 7/1959 Mulders et al. ..... 209/578
2,984,349 A * 5/1961 Mathis ..... 209/555
3,938,435 A * 2/1976 Suda et al. ..... 101/2
4,121,716 A * 10/1978 Luperti et al. ..... 209/564
4,193,489 A * 3/1980 Siniscal ..... 198/406
4,395,033 A * 7/1983 Janssen et al. ..... 271/10.09
4,733,226 A * 3/1988 Kasuya et al. ..... 340/674
5,435,540 A * 7/1995 Martin et al. ..... 271/122

(Continued)

FOREIGN PATENT DOCUMENTS

WO WO 2004007100 A2 * 1/2004

OTHER PUBLICATIONS

"Multifeed Detection System for Document and Paper Handing", Xerox Disclosure Journal, vol. 20, No. 5, Sep./Oct. 1995, pp. 415-417.*

(Continued)

*Primary Examiner*—Patrick H Mackey
*Assistant Examiner*—Gerald W McClain
(74) *Attorney, Agent, or Firm*—Brian K. Seidleck; Eugene I. Shkurko

(57) ABSTRACT

A document processing device that processes a plurality of articles and is capable of detecting a multifeed or a condition that may represent a multifeed may be configured to determine criteria of the multifeed or condition. This is particularly useful for configuring the document processing device to ignore multifeeds or conditions that are considered acceptable. For instance, a user may set predefined overlap criteria. If a detected multifeed criteria or condition criteria meets the predefined overlap criteria, a detection of the multifeed or condition may be ignored. However, if it does not meet the predefined overlap criteria, the detection of the multifeed or condition may cause the document processing device to take predetermined post-processing actions, for example to set an alarm message or halt operation entirely. Alternatively, if a condition is expected, predetermined post-processing actions can be taken if the condition is not detected or does not meet the specified criteria.

21 Claims, 11 Drawing Sheets

U.S. PATENT DOCUMENTS

| | | | | |
|---|---|---|---|---|
| 6,212,130 | B1 * | 4/2001 | Brazeal et al. | 367/93 |
| 6,318,714 | B1 * | 11/2001 | Beskitt et al. | 271/10.01 |
| 6,393,251 | B2 * | 5/2002 | Kono | 399/370 |
| 6,529,259 | B1 * | 3/2003 | Kono | 355/23 |
| 6,588,740 | B2 * | 7/2003 | Brugger et al. | 271/10.03 |
| 6,610,955 | B2 * | 8/2003 | Lopez | 209/584 |
| 6,629,018 | B2 * | 9/2003 | Mondie et al. | 700/228 |
| 6,904,261 | B2 * | 6/2005 | Fujii et al. | 399/382 |
| 7,182,335 | B2 * | 2/2007 | Jean-Michel et al. | 271/258.01 |
| 2002/0005333 | A1 * | 1/2002 | Mondie et al. | 198/618 |
| 2004/0195760 | A1 * | 10/2004 | Zimmermann et al. | 271/258.01 |

OTHER PUBLICATIONS

Fujitsu Press Release—Apr. 17, 2007, Fujitsu Integrates New Document Imaging Technology Into Production-Level Scanners, Sunnyvale, CA,, 3 pgs.

Fujitsu Press Release—Oct. 22, 2007, PFU Launches the A4 Duplex Color fi-6140, the Fastest and Most Compact Scanners in their Class, 2 pgs.

Fujitsu Press Release—Feb. 14, 2006, PFU Launches the fi-5900C A3 Duplex High Speed Color Scanner, 2 pgs.

Fujistu, P3PC-1432-04ENZO, fi-5900C Image Scanner Operator's Guide, Mar. 2007.

Fujitsu, fi-6140/fi-6240 Image Scanner Operator's Guide P3PC-1922-01EN, Sep. 2007.

Bell & Howell Imaging Components S004082 Rev B, Copiscan 8000 Plus Series Operator Manual, Aug. 25, 2000.

Bowe Bell + Howell S005149 Rev C, Copiscan 8000 Spectrum Operator Manual, Jun. 2004.

Fujitsu P3PC-1432-02ENZO, fi-5900C Image Scanner Operator's Guide, Feb. 2006.

Bowe Bell + Howell, Truper Operator Manual, truper 3600 Color Scanner, May 2006.

* cited by examiner

100

200

106

APPARATUS, METHOD AND PROGRAM PRODUCT FOR DETECTING ARTICLE MULTIFEED OVERLAP

CLAIM OF PRIORITY

This application claims priority from U.S. provisional application No. 60/559,652, entitled "Apparatus, Method and Program Product For Detecting Document Multifeed," filed Apr. 6, 2004, the disclosure of which is incorporated herein by reference in its entirety.

TECHNICAL FIELD OF THE INVENTION

The present subject matter relates to multifeed detection, and more particularly, to detection of multifeed of sheets, pages, documents or like articles.

BACKGROUND

In document processing devices that process a plurality of documents one at a time, on occasion multifeeds occur. Multifeeds are the overlapping of sheets, pages, documents, or like articles that are transported through a respective document processing device. Conventionally, when such a multifeed occurs and is detected, an alarm will sound and/or operation of the document processing device will be halted.

Most multifeeds are unacceptable, e.g., in a scanner which will miss scanning part or all of a page when at least two pages are simultaneously fed. The inventors, however, have found that some multifeeds are acceptable, examples of which include a document which is affixed to another document, or special media in which documents detachably overlap. Other acceptable multifeed types are possible and are discussed further herein. When some multifeeds are acceptable, document process devices that trigger an alarm or halt production when even a multifeed is detected degrade throughput because they require a user to check and confirm whether or not each and every multifeed is acceptable.

What is needed is a document processing device that allows for acceptable multifeeds to occur, to increase document processing throughput, but still trigger an alarm for unacceptable multifeeds.

SUMMARY

The disclosed concepts include a method and program product for processing a plurality of articles. When an article is received for processing and a condition is detected that may represent a multifeed including the article, it is determined whether or not the condition represents an unacceptable multifeed based on criteria of the condition relative to the article. In the event that the overlap criteria is within the predefined overlap criteria, article processing continues. Alternatively, in the event that the overlap criteria is not within the predefined overlap criteria, article processing discontinues. Advantageously, each time a condition representing a multifeed is detected, it is determined whether or not the multifeed is unacceptable, thus increasing throughput and decreasing processing time.

Other aspects include a method of processing a plurality of articles. The steps include receiving an article for processing and detecting a condition that may represent a multifeed overlap including the article. The method includes determining whether or not the condition represents an unacceptable multifeed overlap based on criteria of the condition relative to the article. As an example, criteria of the condition is determined by detecting a leading edge of the condition that may represent the multifeed that traverses a direction of article transport, and detecting a trailing edge of the condition that may represent the multifeed that traverses the direction of article transport. Based on these detections, criteria, such as position of the condition may be determined based at least on a preset size of the article, a transport speed of the article, and timing between the two detections.

In another unique aspect, the disclosed concepts include a method and program product of processing a plurality of articles by receiving an article for processing, detecting a multifeed including the article, and determining a position of an overlap of the multifeed relative to the article. It is determined whether the position of the overlap is within an acceptable range to continue processing the article. In the event that the position is within the predefined overlap criteria, article processing continues. In the event that the position is not within the predefined overlap criteria, article processing discontinues.

Another aspect includes a method of processing a plurality of articles. The method includes receiving an article for processing and detecting a multifeed overlap including the article. The method includes determining a position of an overlap of the multifeed overlap relative to the article. A position of the overlap is determined by detecting a leading edge of the overlap of the multifeed that traverses a direction of article transport, detecting a trailing edge of the overlap that traverses the direction of article transport, and determining the position of the multifeed relative to the article based at least on a preset size of the article, a transport speed of the article, and timing between each detection.

In even another unique aspect, the disclosed concepts include a method of processing a plurality of articles by receiving an article for processing, detecting a leading edge of the article relative to a direction of article transport, detecting a trailing edge of the article relative to the direction of article transport, and determining if a condition that may represent a multifeed including the article is present. In an event the condition is not present, article processing discontinues. In an event the condition is present, it is determining whether or not the condition represents an unacceptable multifeed based on criteria of the condition relative to the article.

Even yet another unique aspect of the disclosed concepts includes an article processing device including a transport path on which an article is conveyed, a detector positioned relative to the transport path for detecting a condition that may represent a multifeed including the article, and a controller configured to receive signaling from the detector and process the received signaling for determining criteria of the condition that may represent the multifeed relative to the article. The controller is further configured to determine whether the condition that may represent the multifeed is acceptable by comparing the criteria with a predefined overlap criteria. The controller is also configured to determine the criteria based on a first time of detecting a leading edge of an overlap that traverses a direction of article transport, a second time of detecting a trailing edge of the overlap that traverses the direction of article transport, a size of the article, and a transport speed of the article. The article processing device may further include a feeder configured to separate the article from a plurality of articles and feed the article to the transport path, and a downstream processing device positioned downstream of the transport path to receive the article.

Another unique aspect of the disclosed concepts includes a scanner for detecting a multifeed comprising at least two sheets. The scanner includes a feeder configured to separate a sheet from a plurality of sheets and feed the sheet to a transport path, a multifeed detector positioned relative to the transport path for detecting a multifeed including the sheet, an imaging device positioned downstream of the transport path to receive the sheet, and a controller configured to receive signaling from the multifeed detector and process the received signaling for determining an overlap criteria of the multifeed relative to the sheet. The controller is further configured to determine whether the multifeed is acceptable by comparing the overlap criteria with a predefined overlap criteria. Moreover, the controller is configured to determine the overlap based on a first time of detecting a leading edge of an overlap of the multifeed that traverses a direction of article transport, a second time of detecting a trailing edge of the overlap, a size of the sheet, and a transport speed of the sheet.

Another unique aspect of the disclosed concepts includes a method for processing a flat article by a feeder device. The method includes receiving a first flat article for processing from the feeder device adapted to separate the first flat article from a plurality of stacked articles. The first flat article includes at least four side edges defining surface boundaries of the first flat article. A condition indicating a second flat article confined within the surface boundaries of the first flat article is detected. The second flat article includes one or more side edges defining surface boundaries of the second flat article; does not extend beyond the four side edges of the first flat article; and is smaller in size than the first flat article. Responsive to the detected condition, it is automatically determined whether or not the second flat article represents an unacceptable multifeed condition based on whether the second flat article is contained within a predefined region of the first flat article. The first flat article is processed based on a result of the determining step.

In another unique aspect, the disclosed concepts include a method of processing a flat article by a feeder device. The method includes receiving a first flat article for processing from the feeder device adapted to separate the first flat article from a plurality of stacked articles. The first flat article includes at least four side edges defining surface boundaries of the first flat article. A second flat article confined within the surface boundaries of the first flat article is detected. The second flat article includes one or more side edges defining surface boundaries of the second flat article; does not extend beyond the four side edges of the first flat article; and is smaller in size than the first flat article. Responsive to the detected second flat article, it is automatically determined whether the second flat article conforms to a criteria defining an acceptable multifeed. Normal processing of the first and second flat articles is allowed based upon determining that the second flat article does conform to the criteria defining the acceptable multifeed.

The foregoing and other features, aspects, and advantages of the present subject matter will become more apparent from the following detailed description when taken in conjunction with the accompanying drawings.

DETAILED DESCRIPTION

Figure 1:
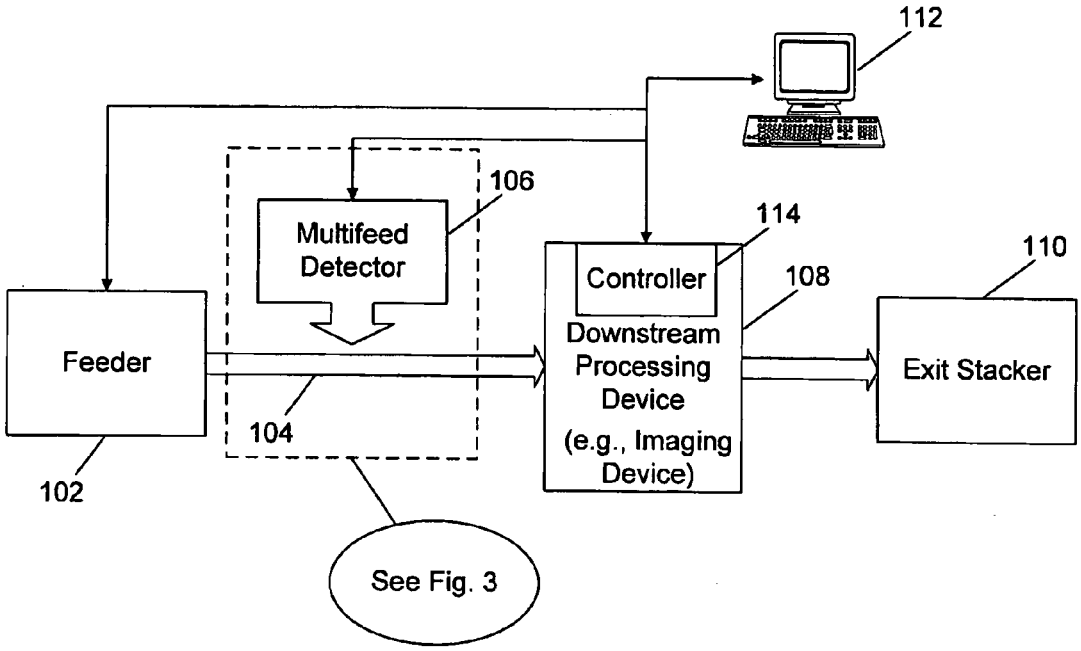
FIG. 1 is an exemplary block diagram of a document processing system.

FIG. 1 illustrates a block diagram of a document processing device 100 for processing a plurality of single documents, sheets, pages, or like articles, that has the capability of detecting multifeed. The term "article" as used herein includes any type of single document, page, sheet, envelope, flat, mailpiece, etc., capable of being separated from a plurality of similar articles and separately transported through the document processing device or other article-handling equipment.

In FIG. 1, feeder device 102 is configured to separate an article from a plurality of articles, e.g., a stack, and feed the separated article to a transport path 104. Any type of feeder device 102 capable of separating an article from a plurality of articles may be used for this purpose. Various types of devices are known to one of ordinary skill in the art. On occasion, feeder device 102 does not completely separate an article from a plurality of articles, causing a multifeed. By positioning a multifeed detector 106 relative to the transport path 104, multifeeds may be detected and a feeder device and/or a downstream processing device 108 may be controlled accordingly. In a normal operation (without the occurrence of a multifeed), each article is conveyed along the transport path 104, applied to downstream processing device 108, and collected by exit stacker 110.

User interface 112 is in communication with controller 114, which is configured to control operation of the document processing device 100. A user may set parameters of operation of the document processing device 100 with user interface 112, for instance to cause controller 114 to disengage multifeed detection by deactivating multifeed detector 106. Other operation parameters may be set, and are known to those of ordinary skill of the art. For example, after a predetermined number of multifeed detections, operation of the feeder device 102 may be halted for inspection and/or a message may be displayed recommending feeder device 102 inspection.

Figure 2:
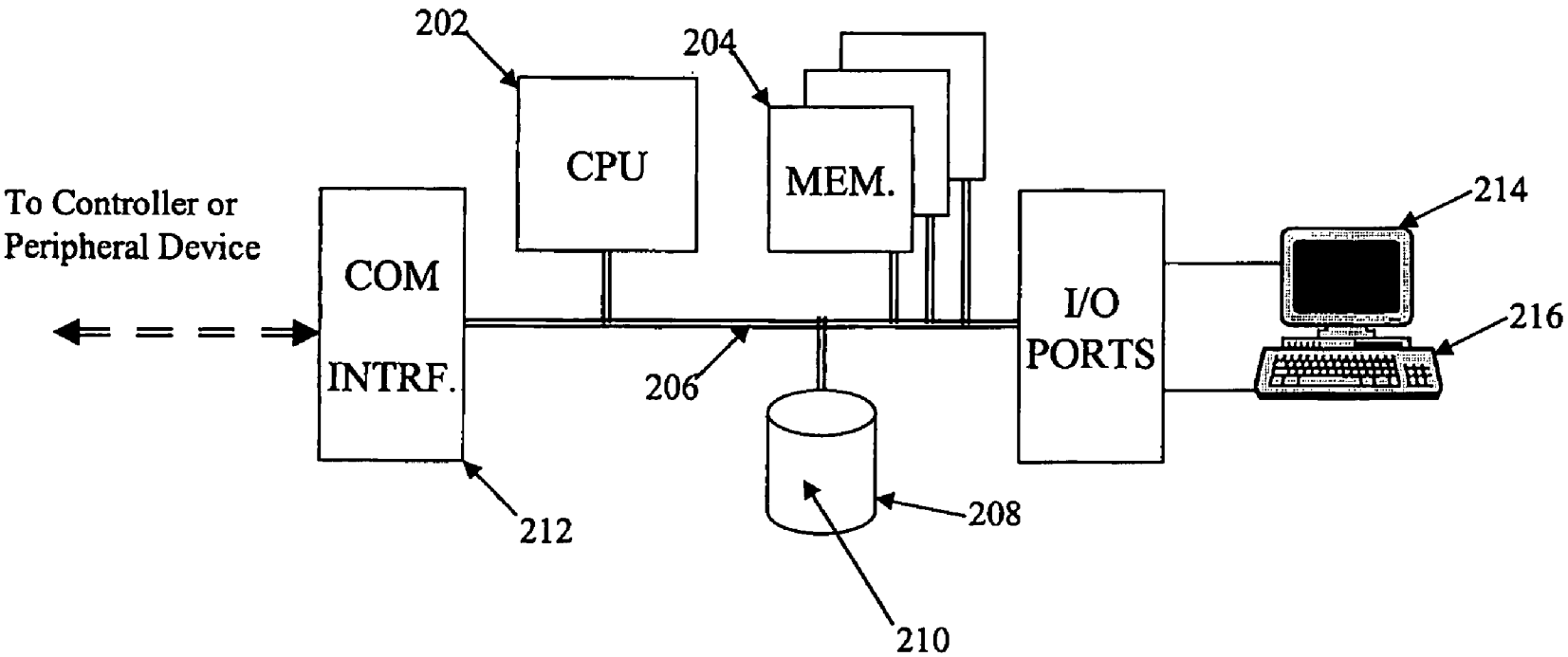
FIG. 2 is an exemplary block diagram of a computer or computer system.

User interface 112, controller 114 or both may be a computer configured with a microprocessor and memory for setting user-defined parameters or controlling the processing of document processing device 100. FIG. 2 is a functional block diagram of such a computer.

The exemplary computer system 200 contains a central processing unit (CPU) 202, memories 204, and an interconnect bus 206. The CPU 202 may contain a single microprocessor, or may contain a plurality of microprocessors for configuring the computer system 200 as a multi-processor system. The memories 204 include a main memory, a read only memory, mass storage devices such as various disk drives, tape drives, etc, or any combination thereof. The main memory typically includes dynamic random access memory (DRAM) and high-speed cache memory. In operation, the main memory stores at least portions of instructions for executing data for processing by the CPU 202.

The mass storage 208 may include one or more magnetic disk or tape drives or optical disk drives, for storing data and instructions for use by CPU 202. For a workstation PC, for example, at least one mass storage system 208 in the form of a disk drive or tape drive, stores the operating system and application software as well as a data or operation file(s) 210. The mass storage 208 within the computer system 200 may also include one or more drives for various portable media, such as a floppy disk, a compact disc read only memory (CD-ROM or DVD-ROM), or an integrated circuit non-volatile memory adapter (i.e. PC-MCIA adapter) to input and output data and code to and from the computer system 200.

The system 200 also includes one or more input/output interfaces 212 for communications, shown by way of example as an interface for data communications to controller 114 or user interface 112 (depending on implementation) or another peripheral device. The interface may be a USB port (for connecting, e.g., a scanner), a modem, an Ethernet card or any other appropriate data communications device. The physical communication links may be optical, wired, or wireless. If used for scanning, the communications enable the computer system 200 to send scans and documentation thereof to a printer (not shown) or another appropriate output or storage device.

If the computer system 200 is used as controller 114, a discrete interface (not shown) also may connect to the multifeed detector 106 to receive data associated with detection, and connect to feeder device 102 for controlling the operation thereof. It is known to those of skill in the art that the computer system 200 need not have all of the components discussed above if used as controller 114. Rather, it may be formed on one or more circuit boards. Any type of communication implementation for receiving and transmitting information to and from components of the document processing device 100 and components external to the document processing device 100 may be utilized.

The computer system 200 may further include appropriate input/output ports for interconnection with a display 214 and a keyboard or keypad 216 serving as the respective user interface. For example, the computer system 200 may include a graphics subsystem to drive the output display. The output display may include a cathode ray tube (CRT) display or liquid crystal display (LCD). These may be integrated with document processing device or separate. Although not shown, computer system 200 may include a port for connection to a printer. The input control devices for such an implementation of the system would include the keyboard for inputting alphanumeric and other key information. The input control devices for the system may further include a cursor control device (not shown), such as a mouse, a trackball, stylus, or cursor direction keys. The links of the peripherals to the system may be wired connections or use wireless communications.

The computer system 200 shown and discussed is an example of a platform supporting processing and control functions of the document processing device 100 described herein. Functions of the document processing device 100 and computer processing operations discussed herein may be controlled by a single computer system, or two separate systems; or one or both of these functions may be distributed across a number of computers.

The software functionalities of the computer system 200 involve programming, including executable code as well as associated stored data. Software code is executable by the general-purpose computer 200 that functions as a device controller. In operation, the code and possibly the associated data records are stored within the general-purpose computer platform 200. At other times, however, the software may be stored at other locations and/or transported for loading into the appropriate general-purpose computer system. Hence, the embodiments involve one or more software products in the form of one or more modules of code carried by at least one machine-readable. Execution of such code by a processor of the computer platform enables the platform to implement the catalog and/or software downloading functions, in essentially the manner performed in the embodiments discussed and illustrated herein.

As used herein, terms such as computer or machine "readable medium" refer to any medium that participates in providing instructions to a processor for execution. Such a medium may take many forms, including but not limited to, non-volatile media, volatile media, and transmission media. Non-volatile media include, for example, optical or magnetic disks, such as any of the storage devices in any computer(s) operating as one of the server platform, discussed above. Volatile media include dynamic memory, such as main memory of such a computer platform. Physical transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include, for example: a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

Referring back to FIG. 1, at times, the feeder device 102 may not completely separate at least two articles, causing a multifeed to be applied to the transport path 104. In this instance, multifeed detector 106 detects a multifeed, and may halt operation of the feeder and/or the document processing device 100 and/or set a multifeed alarm for prompting user intervention. Alternatively, characteristics of a separated article may be interpreted as a multifeed.

Figure 3:
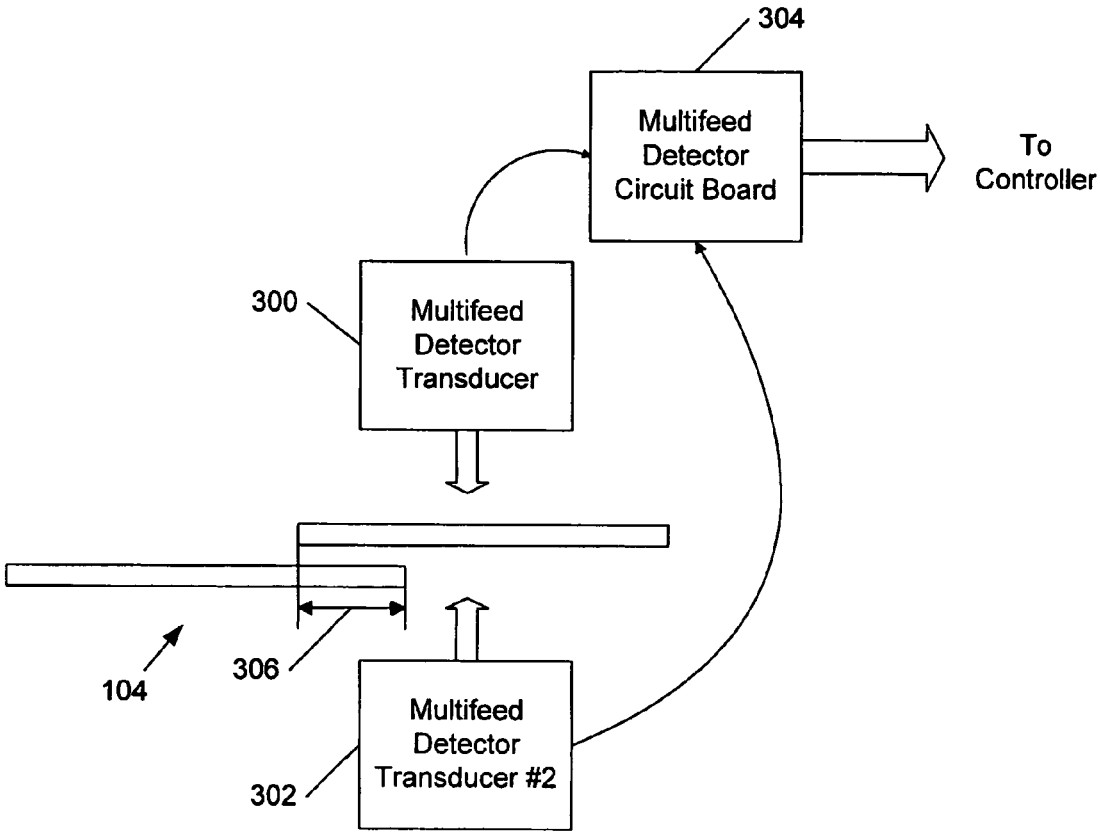
FIG. 3 is an exemplary block diagram of the multifeed sensor illustrated by FIG. 1.

Although the present principles are applicable to processing other types of articles that may be subject to multifeeds, many common examples relate to processing of individual pages or sheets. FIG. 3 illustrates a detailed block diagram of multifeed detector 106 of FIG. 1 for detecting multifeed of individual sheets or pages, etc. at the input of a scanner or the like. The detector 106 includes multifeed transducers 300, 302 opposing one another that are positioned relative to a top and bottom of transport path 104. Multifeed sensor circuit board 304 is in communication with transducers 300, 302, and processes signals received therefrom. Transducers 300, 302 may use ultrasonic waves to detect an airgap between two sheets of paper, and more generally between two articles as in a multifeed. Also, these transducers are configured to detect a single sheet or no sheets. Transducers 300, 302 are particularly useful for detecting an airgap between overlapping sheets or pages. However, other types of multifeed detectors 106 may be used that do not rely on detecting an airgap, and are known to those of skill in the art.

A high-frequency burst waveform is sent through one transducer 300 and received by the other transducer 302. When no article is present, the signal received by the other transducer and processed by multifeed sensor circuit board 304 is at a first level. When one article is present, the signal received by the other transducer 302 and processed by multifeed sensor circuit board 304 is at a second level different from the first level. When an airgap is detected, as would be detected for a multifeed (overlap region 306 shown), the signal received by the other transducer 302 and processed by multifeed sensor circuit board 304 is at a third level different from the first and second level. In this instance, a multifeed is detected. However, a multifeed may be detected under special circumstances, which are discussed further starting with FIG. 5.

Document processing device 100 may embody any type of device which employs a feeder 102 for separating an article from a plurality of articles and a downstream processing device 108 for processing articles separated by feeder 102. Types of devices could include a scanner, printer, fax machine, copy machine, bulk collator, etc. For discussion purposes, explanation will focus on operation of a scanner configured for multifeed detection. For ease of discussion, reference numbers will be used interchangeably. Overall document processing device 100 may be referred to as scanner 100, and then the downstream processing device 108 may be referred to as the actual imaging device 108 within the scanner 100. FIG. 1 even denotes that an imaging device 108 is an exemplar of a document processing device 108. Reference to other components of the document processing device 100 will remain the same.

Figure 4:
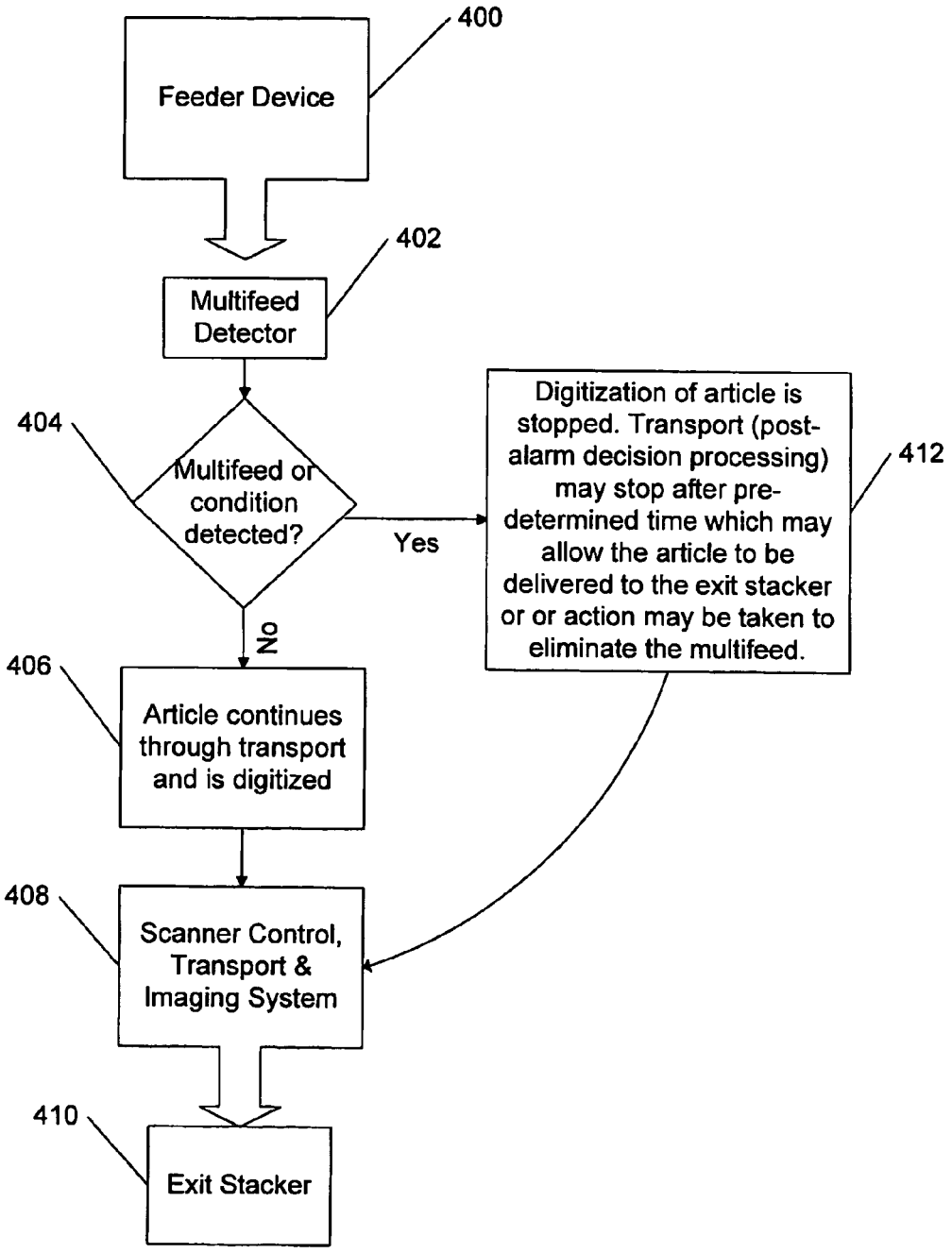
FIG. 4 is an exemplary flow chart of the operation of the document processing system of FIG. 1.

FIG. 4 illustrates a flow diagram of the operation of scanner 100. In this discussion, reference will be made to components illustrated by FIGS. 1 and 3. In step 400, feeder device 102 (FIG. 1) separates an article from a plurality of articles and applies the presumed separated article to transport path 104 (FIG. 1). In step 402, multifeed detector circuit board 304 (FIG. 3) receives a signal from multifeed sensor transducer 302 (FIG. 3), and outputs a signal to the controller 114 (FIG. 1) at either the first, second or third signal level, as is described above. In step 404, controller 114 (FIG. 1) processes the signal(s) received from multifeed detector 106.

When the signal level is at the first or second level, no multifeed is detected. As described above, these signal levels would represent detection of a single article or no article. In step 406, the article continues through the transport path 104, is received by imaging device 108, and is scanned, imaged and digitized. In step 410, the article is collected by the exit stacker 110.

If a multifeed is detected, in step 412, controller 114 (FIG. 1) follows post alarm processing. For example, if document processing device 100 is a printer or copier, upon a multifeed detection, operation may be halted or other post alarm processing logic followed. Then, the multifeed may be conveyed to the exit stacker 110, and/or user intervention may be required or other post alarm processing followed. Other types of post-alarm processing are well within the knowledge of one of ordinary skill in the art. Often, multifeed processing will depend on the device or equipment utilized.

Problems arise when articles applied to scanner 100 include a sheet with a self stick removable note affixed, photographs affixed to a larger sheet, a document having a sticker or other document affixed, articles with an adhesive such as an envelope, and even articles with special print. In these instances, multifeed detector 106 may detect an air gap, i.e., detect a condition that may represent a multifeed, and cause scanner 100 to halt operation. Also, multifeed detector 106 may be spoofed in detecting an airgap as in the case of special print. Notwithstanding, a condition that may represent a multifeed as used herein includes these instances and actual multifeeds. Further novel concepts discussed herein overcome these problems and further optimize scanner 100.

FIGS. 5A, 5B and 5C and 6A, 6B and 6C, respectively illustrate various multifeed types. Other multifeed types are possible, but are not explicitly described herein. Predefined overlap criteria 52, 62, 64, 66 shown in these figures represent parameters set by a user for a particular job or operation of scanner 100. Predefined overlap criteria 52, 62, 64, 66 may correspond to any portion of the overall article 50, 60. However, commonly illustrated is predefined overlap criteria 52 set corresponding to an end portion of a respective overall article 50, 60. Also shown is an overlap criteria ("OC") and a lateral overlap criteria ("LOC"), which is discussed further in connection with FIG. 11. Overlap criteria may also represent criteria of a condition that may represent a multifeed, e.g., as in the case of a photograph affixed to a piece of paper. However, to be consistent, these criterion are simply referred to as overlap criteria.

Figure 5A:
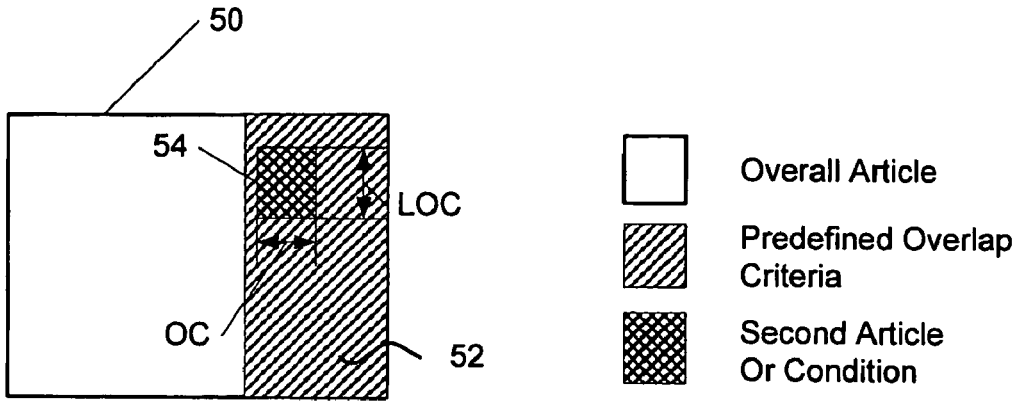
FIG. 5A-C illustrate exemplary multifeed types in which a document is affixed to another document.
Figure 5B:
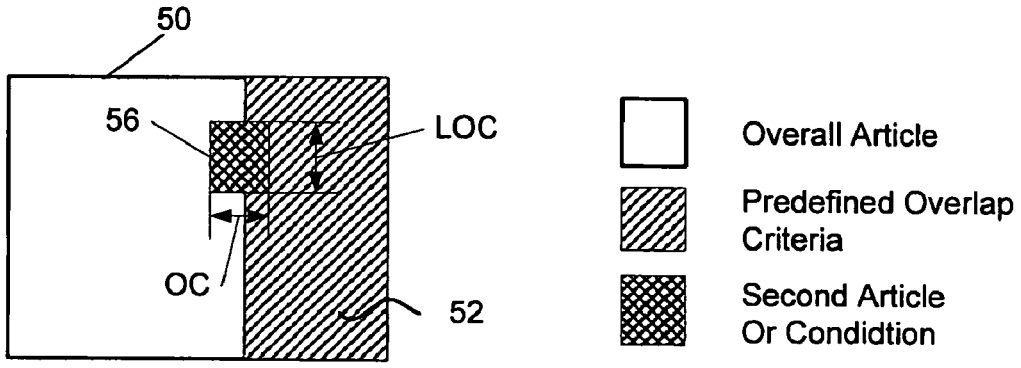
Figure 5C:
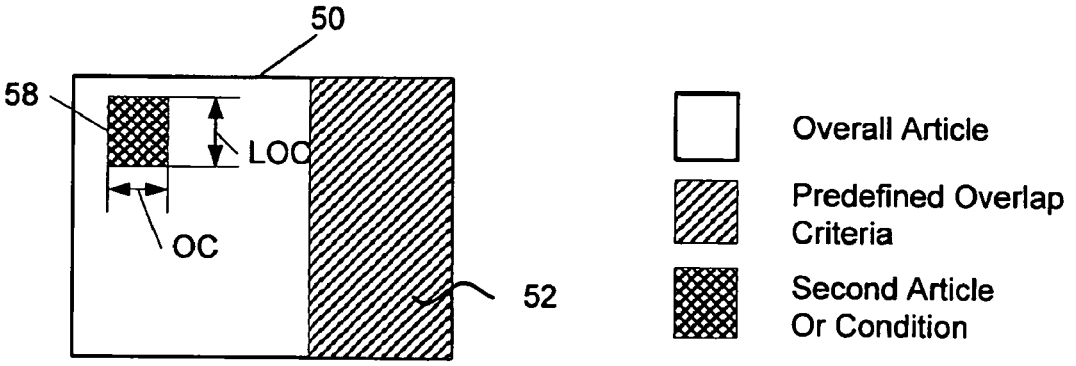

FIGS. 5A to 5C illustrate a second article 54, 56, 58, respectively, affixed to the overall article, respectively, which constitutes the multifeed. Also, the second article 54, 56, 58 may represent a characteristic of the overall article 50 that could be interpreted as a multifeed. For example, the second article 54, 56, 58 may represent an adhesive, special print or ink applied to the overall article 50, which produces an increased thickness that the detector senses and might otherwise interpret as multifeed.

Figure 6A:
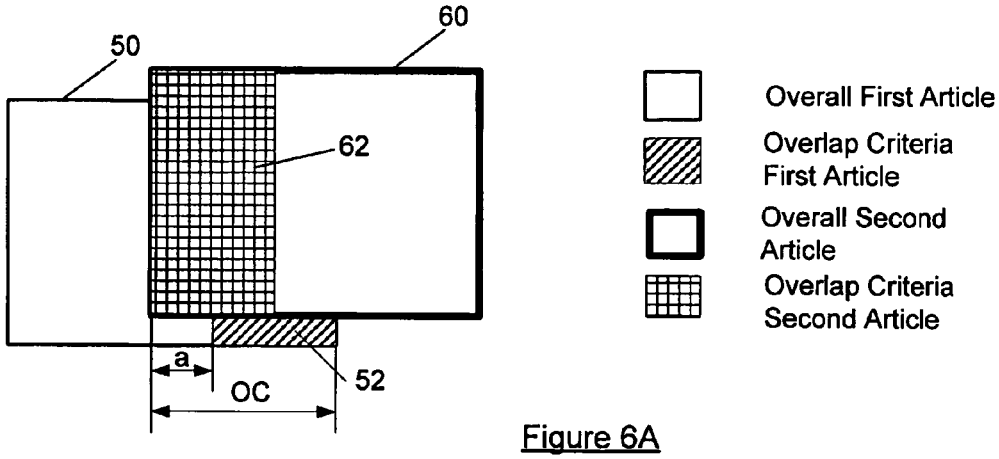
FIG. 6A-C illustrate exemplary multifeed types in which at least two documents overlap.
Figure 6B:
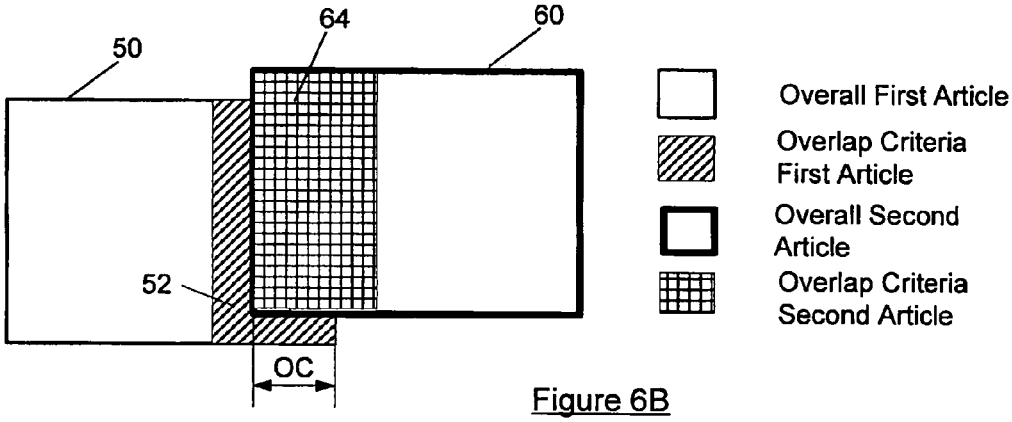
Figure 6C:
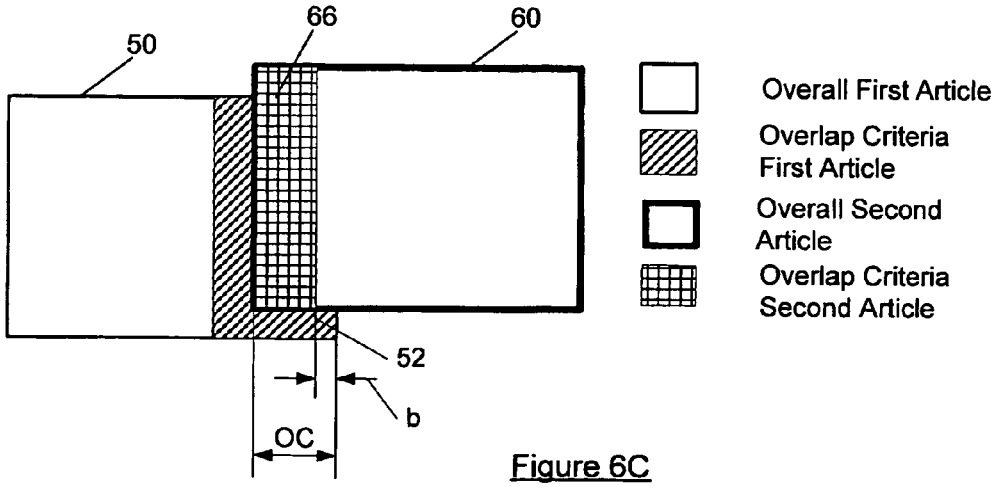

FIGS. 6A to 6C illustrate multifeeds first and second overall articles 50, 60. Each of the first and second overall articled 50, 60 has predefined overlap criteria 52 and 62, 64, 68, respectively. The dimensions of the predefined overlap criteria 52, 62, 64, 66 may be the same, as in FIGS. 6A and B, or may be different, as shown in FIG. 6C. For illustrative purposes, the first and second overall articles 50, 60 are offset to show the actual overlap. In FIG. 6A, the second overall article 60 overlaps with the first overall article 50 and extends beyond the predefined overlap criteria 52 specified for the first overall article 50 by a distance "a." FIG. 6B illustrates a multifeed in which the second overall article 60 overlaps with the first overall article 50, and the overlap is within the predefined overlap criteria 52 defined for the first article 50 and predefined overlap criteria 64 for the second overall article 60. FIG. 6C illustrates a multifeed in which the second overall article overlaps the first overall article 50. As in FIG. 6B, the overlap is within the predefined overlap criteria 52 for the first article 50. However, the overlap is outside the predefined overlap criteria 66 defined for the second article 60 by a distance "b."

Figure 7:
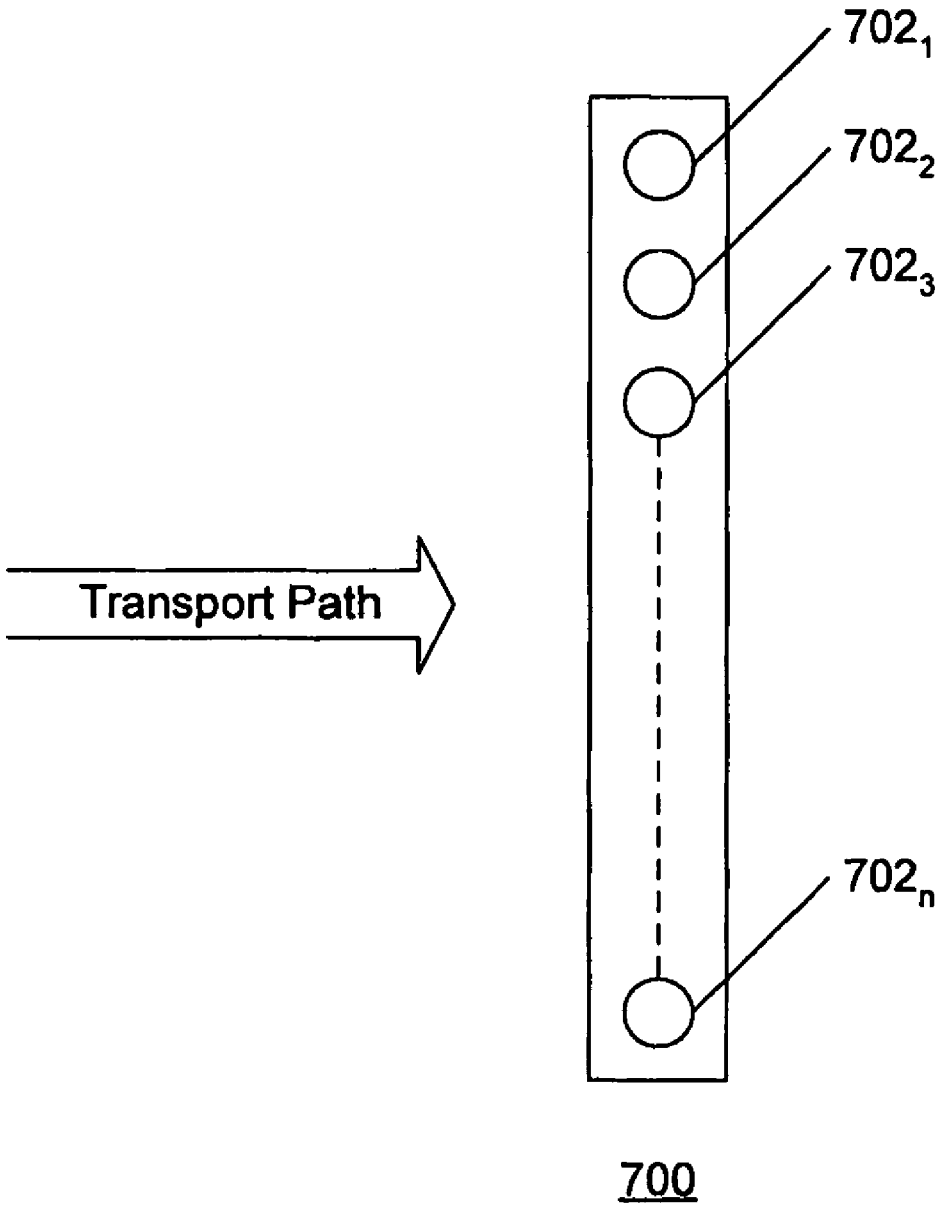
FIG. 7 illustrates an array of multifeed sensors.

In order to detect these various multifeed or condition types described above, multifeed detector 106 (FIG. 1) may include an array 700 of transducers $\mathbf{702}_1$, $\mathbf{702}_2$, $\mathbf{702}_3$ . . . $\mathbf{702}_n$, as shown by FIG. 7. Only one array 700 is illustrated. However, typically two arrays 700 would oppose one another, as is described in connection with the transducers 300 and 302 in FIG. 3. In this manner, the multifeed detector 106 may be configured to detect a multifeed or condition types of various types illustrated by FIGS. 5A to 5C and FIGS. 6A to 6C. In other words, the multifeed detector 106 would be capable of detecting a multifeed or condition along the entire width of the overall article, i.e., traverse the transport path 104. As well, this array approach may be used to detect a multifeed comprising an overlap of articles, as shown in FIG. 6. In this instance, a single set of opposed transducers 302, 304 may be used, as described above in connection with FIG. 3.

For determining whether a multifeed is within an acceptable range, two parameters may be compared. They include the predefined overlap criteria and the overlap criteria (or criteria of the condition that may represent the multifeed).

As is described in connection with FIGS. 5A to 5C and 6A to 6C, predefined overlap criteria 52 and 62, 64 and 66 may be set by a user by specifying the area corresponding to the input media, (i.e., article type). Also, the user may set the type of article applied to the document processing device 100 (e.g., scanner 100), such as letter-size paper. For example, a user may define the predefined overlap criteria 52, 62, 64, 66 to extend a predetermined distance from the leading edge, as is illustrated by FIGS. 5A to 5C or extend a certain distance from the trailing edge, as is illustrated by FIGS. 6A to 6C. Moreover, predefined overlap criteria 52, 62, 64, 66 does not need to be limited to an edge of an article. Rather, predefined overlap criteria 52, 62, 64, 66 may be set to predetermined distances from each edge of an article. In other words, predetermined overlap criteria 52, 62, 64, 66 may be set to any area of the article.

Referring to FIGS. 6A and 6B, predefined overlap criteria 52, 62, 64, may be set to different areas depending on whether an article is leading or trailing another article. For example, in FIG. 6C, a first predefined overlap criteria 66 may be set for an article that leads another article, and a second predefined overlap criteria 52 may be set for an article that trails another article. Setting predefined overlap criteria in this manner may be useful when scanning or copying is only needed for areas outside of the first and second predefined overlap criteria 66, 52.

Figure 8:
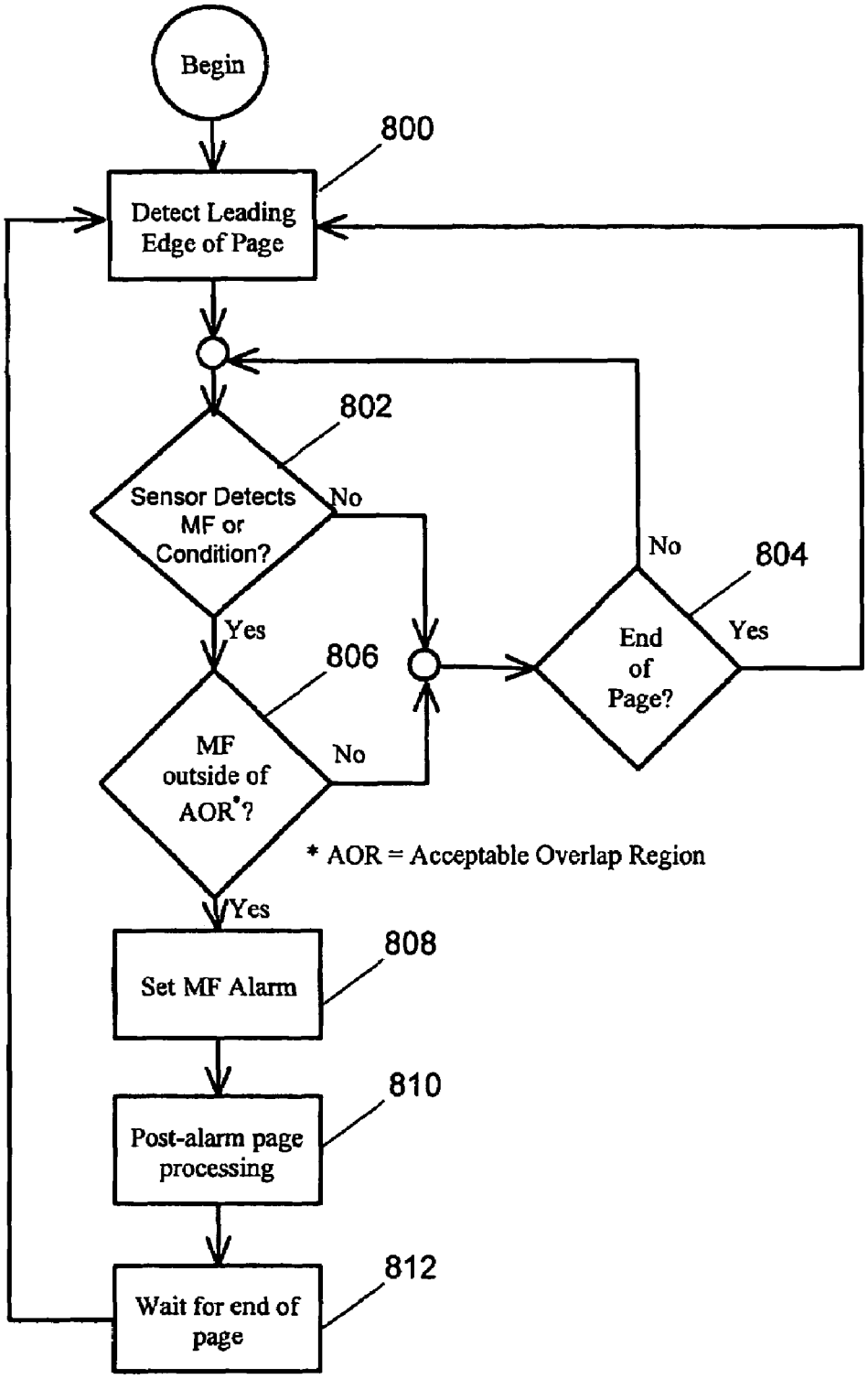
FIG. 8 illustrates a exemplary flowchart of the operation of the document processing device for detecting multifeeds and determining whether or not they are within an acceptable range.

FIG. 8 illustrates a general flow for processing multifeeds. In step 800, the leading edge of an article is detected by the multifeed sensors described herein. In step 802, it is determined whether the sensor detected a multifeed ("MF") or a condition that may represent the multifeed ("condition"). If not, in step 804, it is determined whether the end of the page has been detected. If not detected, the signals from the multifeed detector 106 (FIG. 1) are continually monitored until the end of the article is detected, at which time the detector 106 detects the next leading edge, returning to step 800.

If a multifeed is detected, in step 806, it is determined whether the multifeed or condition is outside of predefined overlap criteria. Controller 114 may factor known dimensions of articles applied, transport speed of the article, detection of the multifeed or condition, etc., for determining the criteria of the multifeed or condition. By comparing these characteristics with predefined overlap criteria 52, 62, 64, 66, it may be determined whether the multifeed or condition is within the acceptable range in accordance with predefined overlap criteria.

As in the case of FIGS. 5B and 5C and FIGS. 6A and 6C, the multifeed or condition would be outside of acceptable range. As a result, in step 808, the multifeed alarm may be set. In step 810, there may be post-alarm page processing, such as halting the scanning operation, tagging a scan of the multifeed including the article for manual review, etc. When in step 812, the end of the multifeed including the article is detected, the process returns to detecting the leading edge of the next article (step 800).

If in step 804, it is determined that the multifeed or condition is within acceptable range, as in the case of FIGS. 5A and 6B, the end of the article is detected in step 804, and the scanner 100 is returned to detecting the next leading edge (step 800). This avoids problems of the prior art.

Figure 9:
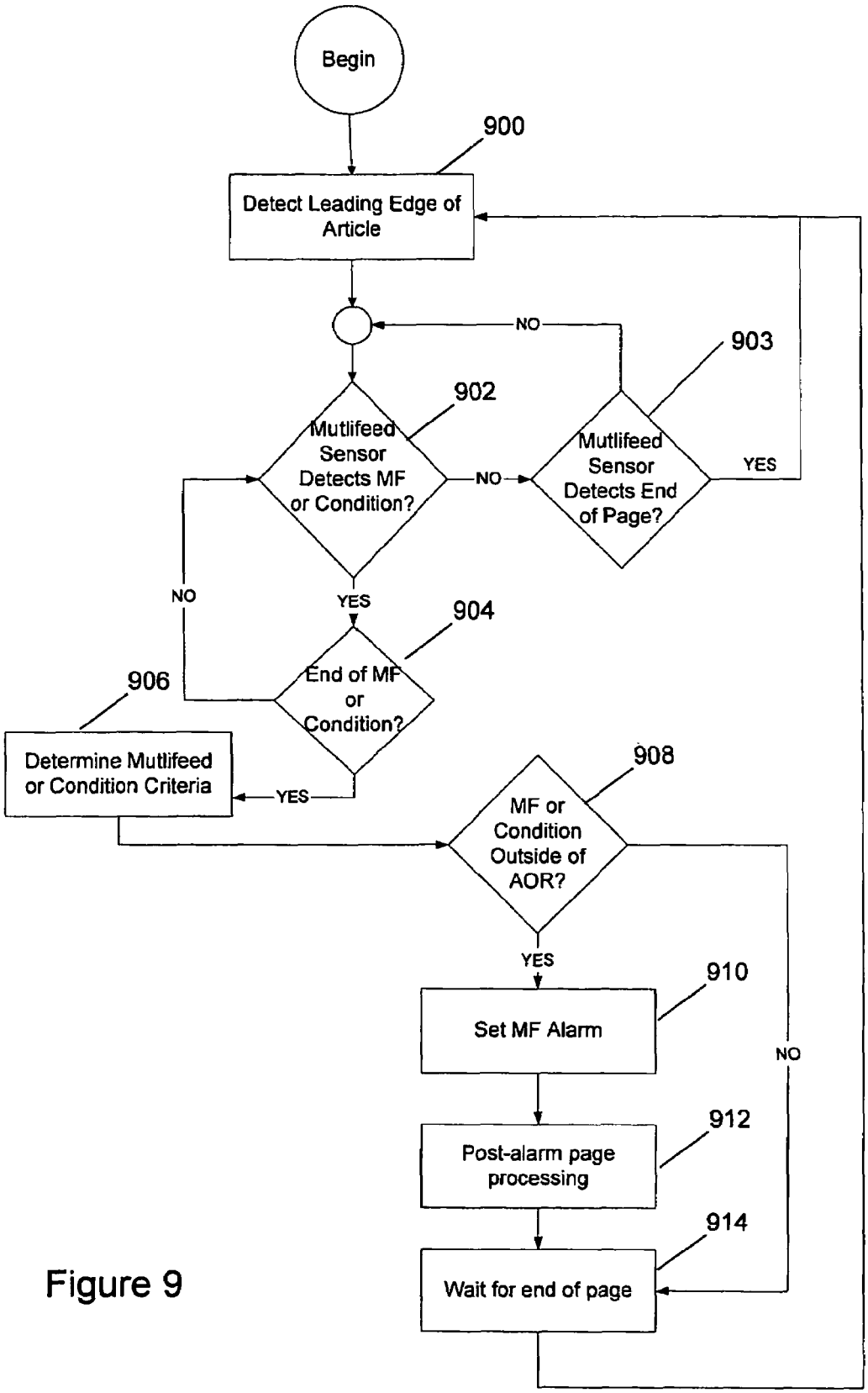
FIG. 9 illustrates a detailed exemplary flowchart corresponding to that of FIG. 8.

FIG. 9 illustrates a flow chart of the operation of the scanner 100 in greater detail.

In step 900, the leading edge of an article is detected by the multifeed detector 106 described herein. In step 902, it is determined whether the multifeed detector 106 detected a multifeed ("MF") or a condition that may represent the multifeed ("condition"). If not, in step 903, it is determined whether the end of the article has been detected. If not detected, the signals from the multifeed detector 106 are continually monitored (returning to step 902) until the end of the article is detected, at which time the multifeed detector 106 detects the next leading edge, returning to step 900.

If a multifeed or condition is detected, in step 904, the multifeed detector 106 is continually monitored (returning to step 902) until the end of the multifeed or condition is detected. In step 906, controller 114 may factor known dimensions of articles applied, transport speed of the article, detection of the multifeed or condition, etc., for determining multifeed overlap or condition criteria. By comparing this criteria with predefined overlap criteria 52, 62, 64, 66, it may be determined whether the multifeed is within the acceptable range in accordance with predefined overlap criteria.

In step 908, it is determined whether the overlap or condition criteria is within an acceptable overlap range, by comparing the overlap or condition criteria with the predefined overlap criteria of the first article, second article or both. If outside of the acceptable range, in step 910, a multifeed alarm is set. In step 912, there may be post-alarm page processing, such as halting the scanning operation, tagging a scan of the multifeed including the article for manual review, etc. When in step 912, the end of the multifeed including the article is detected, the process returns to detecting the leading edge of the next article (step 900).

If in step 908 the multifeed or condition is within the acceptable range, the end of article is detected, and no multifeed alarms is triggered. This overcomes the problems of the prior art.

Figure 10:
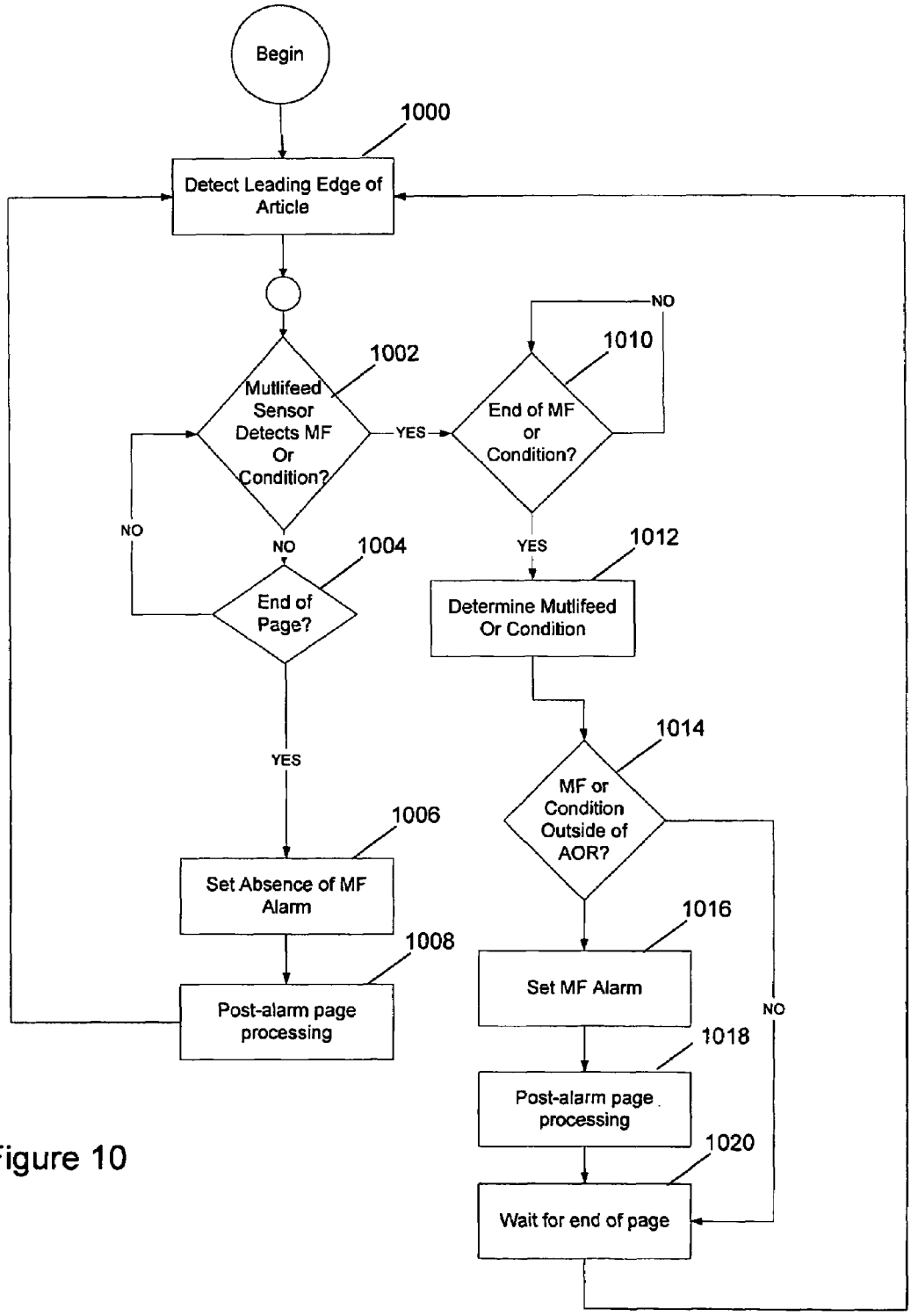
FIG. 10 illustrate an exemplary flowchart of the operation of the document processing device for detecting the absence multifeeds.

Described in connection with FIG. 10, scanner 100 may be configured to detect the absence of a multifeed or a condition that may represent the multifeed ("condition") and trigger a different alarm. This may be applicable for detecting the absence of a label on an envelope. If a multifeed is detected, as described above, it may be determined whether positioning of the overlap or condition criteria is acceptable.

In step 1000, the leading edge of an article is detected. If in step 1002, a multifeed or condition is not detected, and in step 1004, the end of the article is detected, the absence of a multifeed alarm is set, as in step 1006. In step 1008, post-alarm processing may be performed, which may include halting operation or tagging the scan of the article.

If in step 1002, the multifeed detector 106 detects a multifeed or condition, the process continues for determining whether the multifeed or condition is acceptable, as described above. For determining the multifeed or condition criteria, as in step 1012, both the beginning of the multifeed or condition (step 1002) and end of the multifeed or condition (step 1010) may be considered. Controller 114 may factor known dimensions of articles applied, transport speed of the article, detection of the multifeed or condition, etc., for determining characteristics of the criteria of the multifeed or condition.

In step 1016, it is determined whether the overlap or condition criteria is within an acceptable overlap range, by comparing the criteria with the predefined overlap criteria. If outside of the acceptable range, in step 1016, a multifeed alarm is set. In step 1018, there may be post-alarm page processing, such as halting the scanning operation, tagging a scan of the multifeed including the article for manual review, etc. When in step 1020, the end of the multifeed including the article is detected, the process returns to detecting the leading edge of the next article (step 1000). If in within the acceptable range (step 1014), the end of the multifeed is detected, the process returns to detecting the leading edge of the next article.

In step 906 (FIG. 9) and step 1012 (FIG. 10), the position of the multifeed overlap or condition (i.e., criteria) is determined. The overlap or condition criteria may be determined by factoring various parameters including, but not limited to, detection of a leading edge of an article, detection of a trailing edge of an article, detection of a leading edge of the overlap or condition, detection of a trailing edge of the overlap or condition, article size, and article transport speed.

Figure 11:
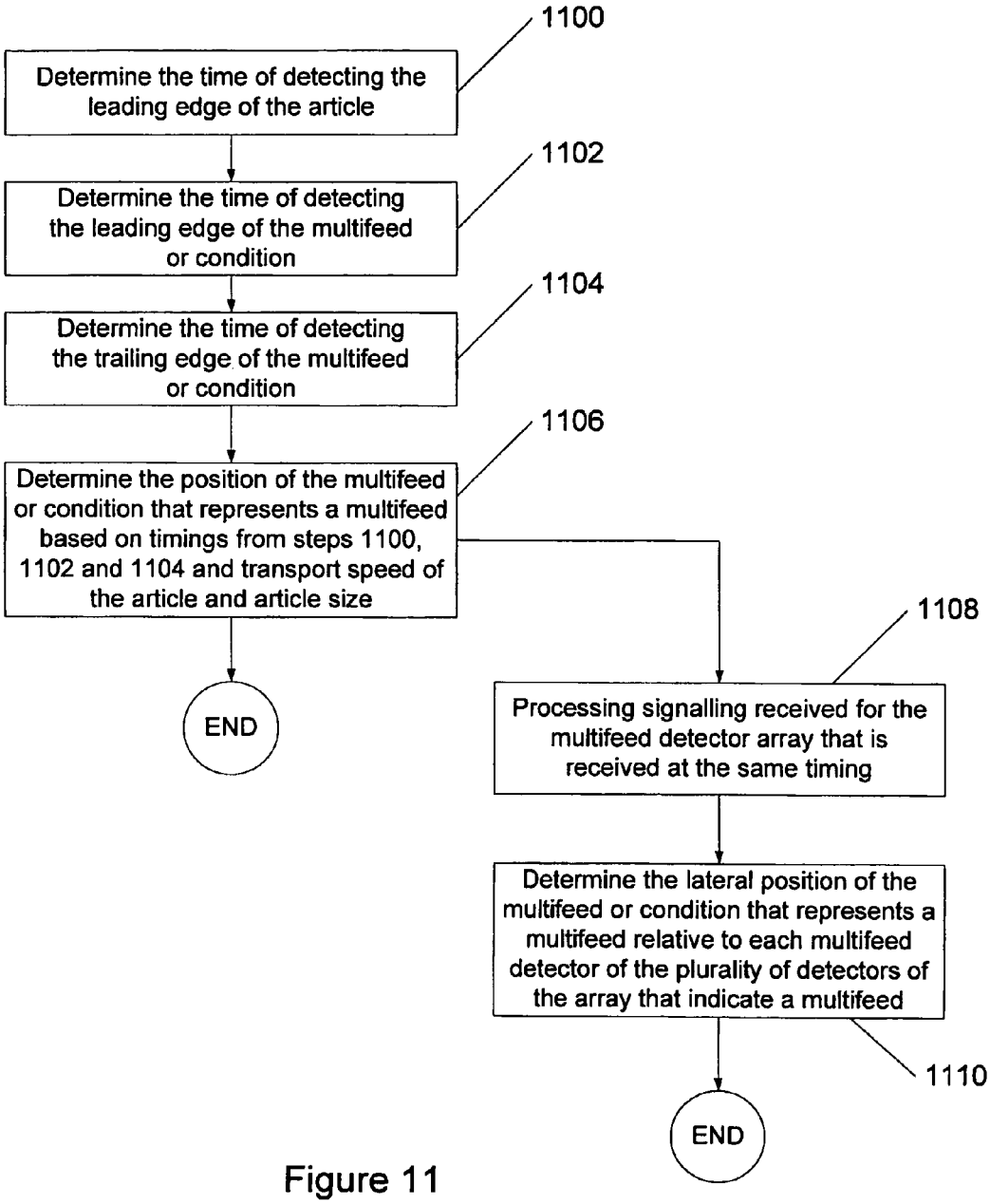
FIG. 11 illustrates an exemplary flowchart for determining overlap region and lateral overlap region.

FIG. 11 illustrates an exemplary flow chart for detecting the position of the overlap criteria or criteria of a condition that may represent a multifeed based on at least these factors. Recall that in step 900 of FIG. 9 and in step 1000 of FIG. 10, the leading edge of the article is detected. Adverting to FIG. 11, in step 1100, the time of this detection (e.g., 0 sec) is determined. When a multifeed detector 106 (FIG. 1) detects a leading edge of an overlap or condition, as in step 1102, the time of the detection (e.g., 1 sec) is determined. Similarly, in step 1104, the time of the detection (e.g., 3 sec) of the trailing edge of the overlap or condition is determined. Because the article size and article transport speed is known, based on the times determined in steps 1100, 1102, and 1104, a length and position of the overlap or condition region relative to the article may be determined. Adverting to FIGS. 5A-C and 6A-C, the length and position of the overlap region ("OC") relative to the respective article is shown.

In FIGS. 5A to 5C, the lateral overlap criteria ("LOC") is shown. Although it is not notated in FIGS. 6A-6C, the LOC would correspond the width of each article. For determining the LOC, the multifeed sensor 700 including an array of transducers $\mathbf{702}_1$, $\mathbf{702}_2$, $\mathbf{702}_3$ . . . $\mathbf{702}_n$, shown by FIG. 7 may be used. Because each transducer $\mathbf{702}_n$ has a fixed position relative to the transport path 104 and article transported on this transport path 104, the LOC size and position may be determined.

For instance, the array of transducers 700 may generate signaling at the same timing for detecting a multifeed or condition. In the event of the multifeed type shown in FIGS. 5A to 5C, a portion of transducers $\mathbf{702}_n$ which is positioned relative to the lateral overlap (LOC) will generate signaling indicating detection of a multifeed or condition. The other portion of the transducers $\mathbf{702}_n$ positioned outside of the LOC will generate signaling that indicates an absence of a multifeed or condition. Therefore, in step 1108, signals received at the same timing (i.e., from each transducer $\mathbf{702}_n$ of the array 700) indicates a position of the LOC. In step 1110, by associating the position of the transducers $\mathbf{702}_n$ that indicate a detection of a multifeed to the article, the LOC may be determined. Additionally, the array of transducers 700 may generate signaling at different timing for detecting a multifeed or condition. In the event of a multifeed in which the overlapped regions are not parallel and perpendicular to each other (a condition known as skew), each transducer in the area of the overlap condition will generate signaling indicating detection of a multifeed or condition at a different time. This represents an angle aspect of the multifeed. Knowing the speed of the paper, the position of the transducer and the timing of the signal allows for determining the skew angle of the overlap which allows for an accurate calculation of the overlap condition.

For example, referring to FIG. 7, consider transducers $\mathbf{702}_2$ and $\mathbf{702}_3$ generate signaling indicating detection of a multifeed or condition. Conversely, transducers $\mathbf{702}_1$ and $\mathbf{702}_4$-$\mathbf{702}_n$ generate signaling that indicates absence of a multifeed or condition. Now adverting to FIGS. 5A to 5C, consider transducers $\mathbf{702}_2$ and $\mathbf{702}_3$ positioned relative to the lateral overlap LOC illustrated. By processing only the signaling received to indicate detection of a multifeed or condition, and associating the position transducers $\mathbf{702}_2$ and $\mathbf{702}_3$ relative to the overall article 50, LOC can be determined.

Although the subject matter has been described and illustrated in detail, it is to be clearly understood that the same is by way of illustration and example only and is not to be taken by way of limitation, the scope of the present invention being limited only by the terms of the appended claims.

What is claimed is:

1. A document imaging scanner comprising:

a transport path;

a feeder device adapted to separate a first flat article from a plurality of stacked flat articles;

one or more ultrasonic detectors positioned traversing the transport path to detect a multifeed condition indicating a second flat article is confined within surface boundaries of the first flat article;

an imaging device positioned downstream of the transport path; and a controller adapted to receive and process signaling from the one or more ultrasonic detectors, the controller configured to determine whether or not the second flat article represents an acceptable multifeed condition based on whether the second flat article is contained within a predefined region of the first flat article.

2. A method of processing a flat article by a document imaging scanner, the method comprising steps of:

receiving a first flat article for processing from a feeder device of the document imaging scanner adapted to separate the first flat article from a plurality of stacked articles, the first flat article including at least four side edges defining surface boundaries of the first flat article;

detecting a condition indicating a second flat article confined within the surface boundaries of the first flat article by way of one or more ultrasonic detectors, wherein:

the second flat article includes one or more side edges defining surface boundaries of the second flat article, the second flat article does not extend beyond the four side edges of the first flat article, and the second flat article is smaller in size than the first flat article;

responsive to the detected condition, determining automatically whether or not the second flat article represents an acceptable multifeed condition based on whether the second flat article is contained within a predefined region of the first flat article; and processing the first flat article based on a result of the determining step.

3. The method of processing the flat article according to claim 2, wherein:

the processing step comprises, in an event that the second flat article is contained within the predefined region of the first flat article, continuing processing the first flat article from the feeder device.

4. The method of claim 3, wherein the step of continuing processing comprises:

feeding the first and second flat articles through an imaging device of the document imaging scanner; and scanning the first flat article and the second flat article with the imaging device.

5. The method of processing the flat article according to claim 2, wherein:

the processing step comprises, in a event that the second flat article is not contained within the predefined region of the first flat article, performing an action based on predetermined post-alarm processing logic.

6. The method of processing the flat article according to claim 2, wherein the step of determining further comprises:

determining a lateral aspect of the second flat article relative to the first flat article based at least on signaling received from a sensor array including a plurality of sensors that traverse the first flat article perpendicular to a direction of first flat article transport.

7. The method of processing the flat article according to claim 2, wherein the step of detecting includes:

detecting the second flat article that is affixed or detachably removable from one or both of the surface boundaries of the first flat article.

8. The method of processing the flat article according to claim 7, wherein the second flat article is attached or detachably removable from an upper surface boundary of the first flat article.

9. The method of processing the flat article according to claim 7, wherein the second flat article is attached or detachably removable from a lower surface boundary of the first flat article.

10. The method of processing the flat article according to claim 7, wherein the second flat article is selected from a self stick removable note, photograph or sticker.

11. The method of processing a flat article according to claim 2, wherein the one or more ultrasonic detectors detects an air gap between the first flat article and second flat article.

12. A method of processing a flat article by a document imaging scanner, the method comprising steps of:

receiving a first flat article for processing from a feeder device of the document imaging scanner adapted to separate the first flat article from a plurality of stacked articles, the first flat article including at least four side edges defining surface boundaries of the first flat article;

detecting a second flat article confined within the surface boundaries of the first flat article by way of one or more ultrasonic detectors, wherein:

the second flat article includes one or more side edges defining surface boundaries of the second flat article, the second flat article does not extend beyond the four side edges of the first flat article, and the second flat article is smaller in size than the first flat article;

responsive to the detected second flat article, determining automatically whether the second flat article conforms to a criteria defining an acceptable multifeed; and allowing normal processing of the first and second flat articles based upon determining that the second flat article does conform to the criteria defining the acceptable multifeed.

13. The method of claim 12, wherein the normal processing comprises:

feeding the first and second flat article through an imaging device of the document imaging scanner; and scanning the first flat article and the second flat article with the imaging device.

14. The method of claim 12, wherein the criteria defining the acceptable multifeed includes a length of the second flat article, the length determined by the following steps:

detecting a leading side edge of the second flat article that traverses a direction of first flat article transport; and detecting a trailing side edge of the second flat article that traverses a direction of first flat article transport.

15. The method of claim 14, wherein the determining step comprises:

comparing the determined length to a predefined length criteria.

16. The method of claim 12, wherein the determining step includes:

determining a lateral aspect of the second flat article relative to the first flat article based at least on signaling received from a sensor array including a plurality of sensors that traverse the first flat article perpendicular to a direction of first flat article transport.

17. The method of processing the flat article according to claim 12, wherein the step of detecting includes:

detecting the second flat article that is affixed or detachably removable from one or both of the surface boundaries of the first flat article.

18. The method of processing the flat article according to claim 17, wherein the second flat article is attached or detachably removable from an upper surface boundary of the first flat article.

19. The method of processing the flat article according to claim 17, wherein the second flat article is attached or detachably removable from a lower surface boundary of the first flat article.

20. The method of processing the flat article according to claim 19, wherein the second flat article is selected from a self stick removable note, photograph or sticker.

21. The method of processing a flat article according to claim 12, wherein the one or more ultrasonic detectors detects an air gap between the first flat article and second flat article.

* * * * *

UNITED STATES PATENT AND TRADEMARK OFFICE

CERTIFICATE OF CORRECTION

PATENT NO. : 7,654,521 B2
APPLICATION NO. : 11/019108
DATED : February 2, 2010
INVENTOR(S) : Roland M. Simonis et al.

It is certified that error appears in the above-identified patent and that said Letters Patent is hereby corrected as shown below:

| Issued Patent | | Description of Error |
|---|---|---|
| **Column** | **Line** | |
| 12 | 66 | In Claim 5, delete "a" and insert -- an --, therefor. |
| 14 | 7 | In Claim 13, delete "article" and insert -- articles --, therefor. |

Signed and Sealed this
Twelfth Day of July, 2011

David J. Kappos

David J. Kappos
*Director of the United States Patent and Trademark Office*